US007095269B2

(12) United States Patent
Yamada

(10) Patent No.: US 7,095,269 B2
(45) Date of Patent: Aug. 22, 2006

(54) VOLTAGE GENERATOR

(75) Inventor: Hitoshi Yamada, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 11/187,837

(22) Filed: Jul. 25, 2005

(65) Prior Publication Data

US 2005/0254314 A1 Nov. 17, 2005

Related U.S. Application Data

(62) Division of application No. 10/421,869, filed on Apr. 24, 2003, now Pat. No. 6,927,621.

(30) Foreign Application Priority Data

Sep. 11, 2002 (JP) ..... 2002-265725

(51) Int. Cl.
*G05F 1/575* (2006.01)
*G05F 1/46* (2006.01)

(52) U.S. Cl. ..... 327/537; 327/541; 327/543; 323/315

(58) Field of Classification Search ..... None
See application file for complete search history.

(56) References Cited

U.S. PATENT DOCUMENTS 4,825,142 A 4/1989 Wang
5,394,026 A 2/1995 Yu et al.
5,670,907 A 9/1997 Gorecki et al.
5,744,998 A 4/1998 Ito et al.
5,760,614 A * 6/1998 Ooishi et al. ..... 327/77
5,834,967 A 11/1998 Kuroda et al.
5,952,871 A 9/1999 Jeon
5,999,009 A * 12/1999 Mitsui ..... 324/765
6,016,072 A * 1/2000 Ternullo et al. ..... 327/535
6,020,780 A * 2/2000 Ozeki ..... 327/540
6,700,434 B1 * 3/2004 Fujii et al. ..... 327/534
6,927,620 B1 * 8/2005 Senda ..... 327/536

* cited by examiner

*Primary Examiner*—Timothy P. Callahan
*Assistant Examiner*—Terry L. Englund
(74) *Attorney, Agent, or Firm*—VolentineFrancos&Whitt,PLLC

(57) ABSTRACT

When the substrate bias voltage Vbb lowers by the pumping operation of the charge pump circuit, a drain-to-source resistance of the N-transistor becomes high. When a first power supply voltage Vcc is set at high value, a drain-to-source current of the N-transistor increases (I+ΔI1), however the drain-to-source current decreases (I+ΔI1−ΔI2) by the increase of the drain-to-source current owing to the substrate bias effect so that the increase of the potential of the node N34 caused by the increase of the first power supply voltage VCC is restrained. As a result, a reference level of the substrate bias voltage Vbb does not largely lower than the reference level of the substrate bias voltage. Vbb when the first power supply voltage VCC is in a standard level.

24 Claims, 8 Drawing Sheets

VOLTAGE GENERATOR

CROSS REFERENCE TO RELATED APPLICATIONS

This is a divisional application of application Ser. No. 10/421,869, filed Apr. 24, 2003, now U.S. Pat. No. 6,927, 621, which is hereby incorporated by reference in its entirety for all purposes.

FIELD OF THE INVENTION

The invention relates to a voltage generator, particularly to a voltage generator capable of keeping a potential of a semiconductor device at a given level.

BACKGROUND OF THE INVENTION

Each memory for constituting a DRAM (Dynamic Random Access Memory) is generally provided with an N-channel transistor (N-transistor) 100 and a capacitor 101, as shown in FIG. 9.

A drain of the N-transistor 100 is connected to a bit line BL, a gate thereof is connected to a word line WL and a source thereof is connected to a node N100. Further, a substrate bias voltage Vbb (e.g. −1.0V) which is outputted from a charge pump circuit (not shown) is applied to a back gate of the N-transistor 100.

The capacitor 101 is formed, e.g. as a parallel flat plate type. One terminal of the capacitor 101 is connected to the node N100 while the other terminal thereof is connected to a node N101. A voltage which is half as much as a first power supply voltage Vcc is applied to the node N101

FIG. 10 shows a sectional view of each memory cell. An N-type well 111 is formed on a P-type substrate 110 and a P-type well 112 is formed inside the N-type well 111. Further, an $N^+$ type impurity region 121 and an $N^+$ type impurity region 122 are formed inside the P-type well 112, which respectively form a source and a drain of the N-transistor 100.

A second power supply voltage Vss (e.g. 0V) is applied to the P-type substrate 110 and the first power supply voltage Vcc is applied to the N-type well 111 while the substrate bias voltage Vbb is applied to the P-type well 112.

Since the substrate bias voltage Vbb is applied to the P-type well 112, even if there is a noise on the word line WL, an electric charge which is charged in the capacitor 101 is not moved toward the $N^+$ type impurity region 122 through the $N^+$ type impurity region 121. That is, it is possible to prevent data stored in each memory from leaking.

SUMMARY OF THE INVENTION

Meanwhile a small amount of the electric charge which is charged in the capacitor 101 is moved toward the P-type well 112 via the $N^+$ type impurity region 121. This phenomenon is caused by a lattice defect which is present on a joint surface between the $N^+$ type impurity region 121 and P-type well 112, and it is very difficult to completely prevent the occurrence of this phenomenon. Particularly, in cases where a potential difference between the $N^+$ type impurity region 121 and P-type well 112 is large, the movement of the electric charge is liable to occur. That is, data leakage phenomenon occurs significantly, resulting in the reduction of data holding time of the DRAM. The conventional substrate bias voltage generator has such a problem.

The conventional substrate bias voltage generator comprises a charge pump circuit for outputting the substrate bias voltage Vbb and a voltage level detection circuit (not shown) for detecting a level of the substrate bias voltage Vbb which is outputted from the charge pump circuit. The charge pump circuit adjusts a level of the substrate bias voltage Vbb to output it upon reception of a voltage level detection signal which is outputted from the voltage level detection circuit.

However, since the DRAM is a type of memories which are driven at a high voltage, in cases where the first power supply voltage Vcc is set at high value, the substrate bias voltage Vbb has largely lowered conventionally in response to the level of the first power supply voltage. Vcc. If the substrate bias voltage Vbb lowers, which should be ideally always constant, even if the first power supply voltage Vcc rises, the difference in potential between the $N^+$ type impurity region 121 and the P-type well 112 is made larger, so that the data holding time is cut down.

The invention has been developed in view of the foregoing problem, and it is an object of the invention to provide a voltage generator for outputting a voltage having an excellent property even if a power supply voltage and the like are fluctuated.

To achieve the above object, a first aspect of the invention provides the voltage generator comprising a voltage level detection circuit, and a voltage generator circuit for raising a level of an output voltage when a voltage level detection signal outputted from the voltage level detection circuit is in a first logical level and lowering the level of the output voltage when the voltage level detection signal is in a second logical level. The voltage level detection circuit is characterized in comprising a logical level decision means for deciding a logical level of the voltage level detection signal in response to a potential of a detection node, a first adjustment means for adjusting the potential of the detection node in response to a level of the output voltage outputted by the voltage generator circuit and a level of a power supply voltage, and a second adjustment means for adjusting the amount of adjustment of the potential of the detection node by the first adjustment means. With such an arrangement of the voltage generator, even if there is a possibility that the potential of the detection node is fluctuated largely by the fluctuation of the power supply voltage, a margin of fluctuation can be controlled by the second adjustment means. As a result, the output voltage outputted by the voltage generator circuit can be adjusted within fixed ranges. The voltage generator circuit is configured such that it is rendered in an Off operating state to raise the level of the output voltage when the voltage level detection signal outputted from the voltage level detection circuit is the first logical level while it is rendered in an ON operating state to lower the level of the output voltage when the voltage level detection signal outputted from the logical level detection circuit is the second logical level.

The second adjustment means adjusts the amount of adjustment of the potential of the detection node by the first adjustment means in response to the level of the output voltage outputted from the voltage generator circuit. It is possible to adjust more properly and automatically the fluctuation of the output voltage outputted from the voltage generator circuit.

The voltage level detection circuit comprises a first resistor element having one end to which the output voltage outputted from the voltage generator circuit is applied, a first transistor having a first power supply terminal to which a power supply voltage is applied and a second power supply terminal to which the detection node is connected, a second transistor having a first power supply terminal to which the detection node is connected, and a second power supply terminal to which the other end of the first resistor element is connected, and a second resistor element for adjusting a current flowing between the first and second power supply terminals of the first transistor and a current flowing between the first and second power supply terminals of the second transistor. The first transistor, the second transistor, and the first resistor element constitute the first adjustment means while the second resistor element constitutes a second adjustment means.

The second resistor element is formed of a third transistor having a back gate to which the output voltage outputted from the voltage generator circuit is applied. Likewise, the first resistor element is formed of a fourth transistor.

A second aspect of the invention provides a voltage generator comprising a voltage level detection circuit group, and a voltage generator circuit for raising a level of an output voltage when a voltage level detection signal outputted from the voltage level detection circuit group is in a first logical level and lowering the level of the output voltage when the voltage level detection signal is in a second logical level. The voltage level detection circuit group includes a first voltage level detection circuit for outputting a first voltage level detection signal, a second voltage level detection circuit for outputting a second voltage level detection signal, and a selection circuit for selecting either the first voltage level detection signal or second voltage level detection signal to output the selected signal as the voltage level detection signal. The first voltage level detection circuit and the second voltage level detection circuit are characterized in that they independently change a logical level of the first voltage level detection signal and a logical level of the second voltage level detection signal in response to the level of the output voltage outputted from the voltage generator circuit or a given characteristic parameter. With such a configuration, the voltage generator can output an output voltage which is adjusted to the optimum level in various operating modes which are fluctuated by characteristic parameters.

In cases where the voltage generator is operated by changing the power supply voltage, the power supply voltage is used as a characteristic parameter while in cases where it is operated under the environment where an ambient temperature is changed, temperature is used as the characteristic parameter.

BRIEF DESCRIPTION OF THE DRAWINGS

While the specification concludes with claims particularly pointing out and distinctly claiming the subject matter which is regarded as the invention, it is believed that the invention, the objects, features and advantages thereof will be better understood from the following description taken in connection with the accompanying drawings in which:

DETAILED DESCRIPTION OF THE PREFERRED EMBODIMENTS

Figure 1:
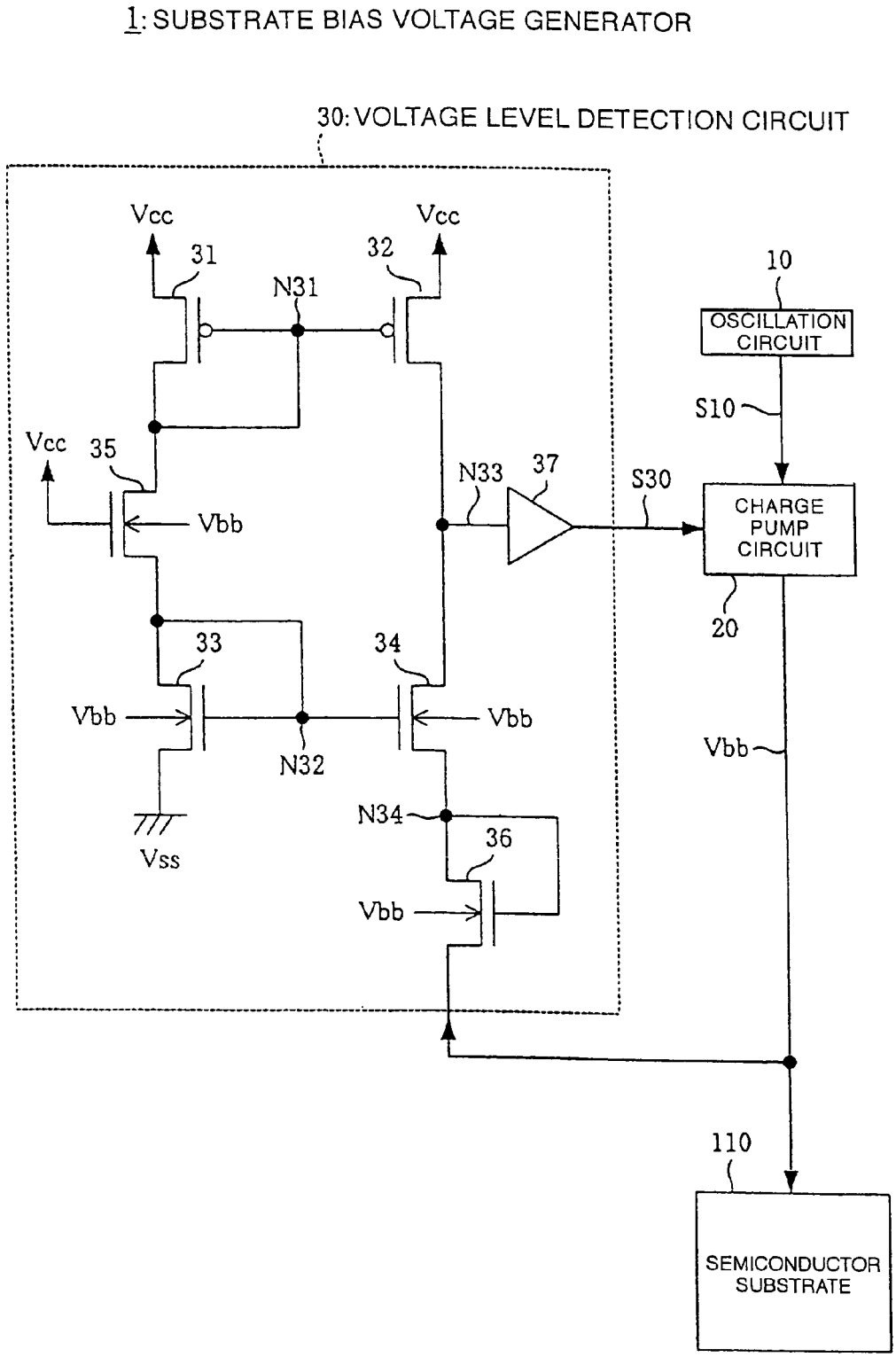
FIG. 1 is a block diagram showing a configuration of a substrate bias voltage generator according to a first embodiment of the invention.

Preferred embodiments of a voltage generator according to the invention is now described in detail with reference to the attached drawings. Components having substantially the same function and configuration in the following description and attached drawings are depicted by the same reference numerals and overlapped explanation thereof is omitted.

A configuration of a substrate bias voltage generator 1 according to the first embodiment of the invention is illustrated in FIG. 1. The substrate bias voltage generator 1 outputs a substrate bias voltage Vbb to be applied to a semiconductor substrate 110 and includes an oscillation circuit 10, a charge pump circuit 20, and a voltage level detection circuit 30.

The oscillation circuit 10 incorporates therein e.g. a ring oscillator and outputs a pulse signal S10 having a fixed cycle.

The charge pump circuit 20 is mainly formed of a capacitor and a transistor, and repeats charge and discharge in synchronization with the pulse signal S10, thereby generating the substrate bias voltage Vbb. The substrate bias voltage Vbb outputted from the charge pump circuit 20 is applied to the semiconductor substrate 110 and is also inputted to the voltage level detection circuit 30.

The voltage level detection circuit 30 detects a level of the substrate bias voltage Vbb and outputs a voltage level detection signal S30 of a logical high level (hereinafter referred to as "H level") or a logical low level (hereinafter referred to as "L level") in response to the level of the substrate bias voltage Vbb. The voltage level detection signal S30 is inputted to the charge pump circuit 20 as a signal for controlling the operation of the charge pump circuit 20.

The charge pump circuit 20 is rendered in an ON operating state when the voltage level detection signal S30 is in H level to lower the substrate bias voltage Vbb to output the lowered substrate bias voltage Vbb, and is rendered in an OFF operating state when the voltage level detection signal S30 is in L level to raise the substrate bias voltage Vbb and output the raised substrate bias voltage Vbb.

As set forth above, the charge pump circuit 20 and voltage level detection circuit 30 form a feedback loop relative to the substrate bias voltage Vbb. The substrate bias voltage generator 1 supplies the substrate bias voltage Vbb, which is adjusted to e.g. −1.0V, to the semiconductor substrate 110.

Then the internal configuration of the voltage level detection circuit 30 is described in detail. The voltage level detection circuit 30 includes P-channel transistors (hereinafter referred to as P-transistor) 31, 32, N-transistors 33, 34, 35, 36 and a buffer circuit (logical level decision means) 37.

A first power supply voltage Vcc is applied to a source of the P-transistor 31 and a source of the P-transistor 32. A gate and a drain of the P-transistor 31 are connected to a node N31. A gate of the P-transistor 32 is connected to the node N31 and a drain thereof is connected to a node (detection node) N33.

A drain of the N-transistor 35 is connected to the node N31 and a source thereof is connected to a node N32. The first power supply voltage Vcc is applied to a gate of the N-transistor 35 and the substrate bias voltage Vbb is applied to a back gate thereof.

A drain and a gate of the N-transistor 33 are connected to the node N32. A second power supply voltage Vss is applied to a source of the N-transistor 33 and the substrate bias voltage Vbb is applied to a back gate thereof.

A drain of the N-transistor 34 is connected to the node N33 while a gate thereof is connected to the node N32 and a source thereof is connected to a node N34.

A drain and a gate of the N-transistor 36 are connected to the node N34. The substrate bias voltage Vbb is applied to a source and a back gate of the N-transistor 36. The N-transistor 36 functions as a resistor element and a P-transistor may be employed in place of the N-transistor 36.

The P-transistor 31 and P-transistor 32 constitute a first current mirror circuit while the N-transistor 33 and N-transistor 34 constitute a second current mirror circuit. That is, the P-transistor 31 and P-transistor 32 are mutually formed in the same dimensions while the N-transistor 33 and N-transistor 34 are mutually formed in the same dimensions. Further, each transistor may be formed such that a gate length of the P-transistor 31 is the same as that of the P-transistor 32, and a gate length of the N-transistor 33 is the same as that of the N-transistor 34 while a ratio of gate width of the P-transistor 31 and P-transistor 32 coincides with a ratio of gate width of the N-transistor 33 and N-transistor 34.

The N-transistor 35 positioned between the first current mirror circuit and second current mirror circuit functions as a resistor element for controlling a current flowing in both the first and second current mirror circuits.

The buffer circuit 37 amplifies an analog voltage signal to be outputted to the node N33 and outputs the voltage level detection signal S30. The voltage level detection signal S30 is a logical signal having H level and L level and a voltage level of the voltage level detection signal S30 at H level is equal to the first power supply voltage Vcc while a voltage level thereof at L level is equal to the second power supply voltage Vss.

Figure 2:
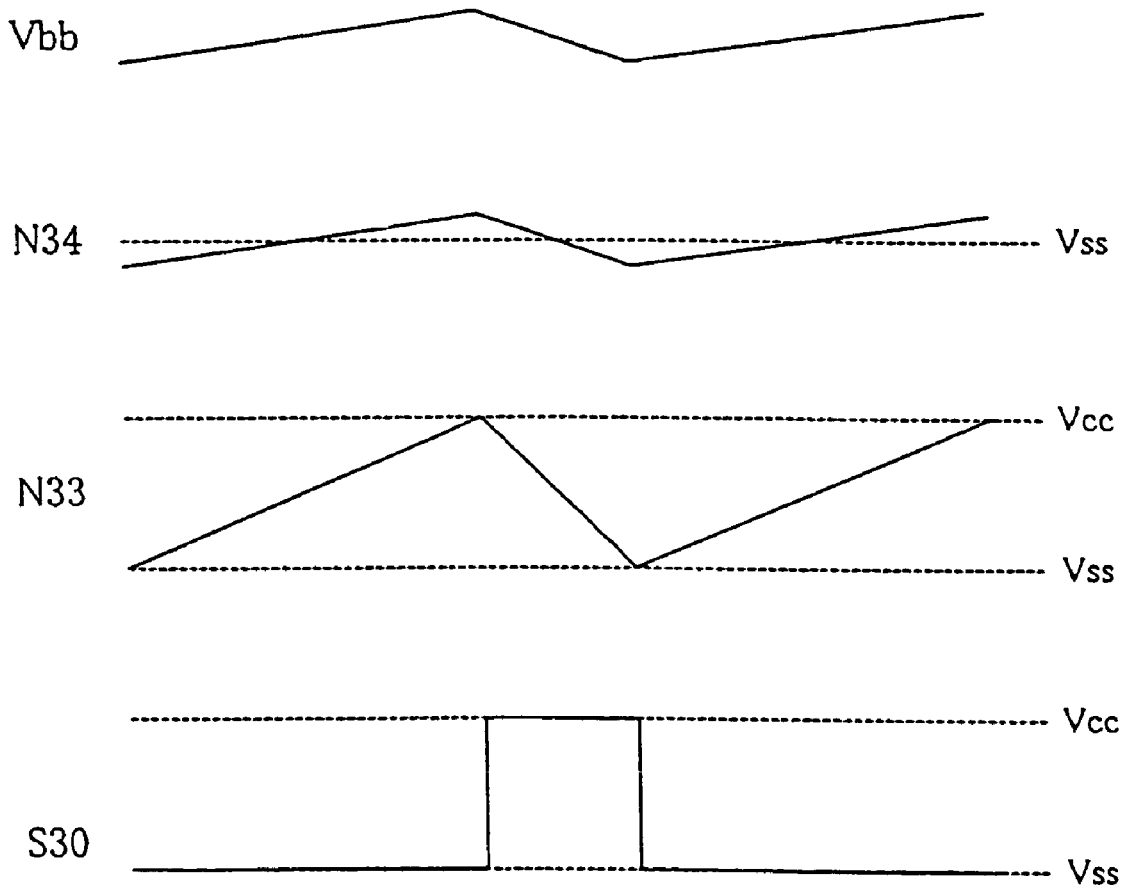
FIG. 2 is a view showing voltage waveforms representing operation of a voltage level detection circuit of the substrate bias voltage generator shown in FIG. 1.

The operation of the substrate bias voltage generator according to the first embodiment having the foregoing configuration is now described with reference to FIG. 1 and FIG. 2.

If the substrate bias voltage Vbb keeps a reference value (e.g. −1.0V), the potential of the node N34 coincides with the second power supply voltage Vss (e.g. 0V). If the substrate bias voltage Vbb is fluctuated, the potential of the node N34 is also fluctuated, and also the potential of the node N33 is also fluctuated respectively depending on the fluctuation of the substrate bias voltage Vbb.

Described first of all is the operation of the substrate bias voltage generator 1 when the substrate bias voltage Vbb becomes higher than the reference value.

If the substrate bias voltage Vbb becomes higher than the reference value, the potential of the node N34 becomes higher than the second power supply voltage Vss. Consequently, a gate-to-source voltage of the N-transistor 34 lowers while a drain-to-source voltage of the N-transistor 34 rises. If the substrate bias voltage Vbb further rises, a drain-to-source resistance of the N-transistor 34 becomes high by the amount of further rising of the substrate bias voltage Vbb and the potential of the node N33 rises up to the first power supply voltage Vcc.

The buffer circuit 37 changes the voltage level detection signal S30 from L level to H level when the potential of the node N33 rises up to the given value, and supplies it to the charge pump circuit 20. The charge pump circuit 20 starts its pumping operation upon reception of the voltage level detection signal S30 of H level. As a result, the substrate bias voltage Vbb lowers.

Described next is an operation of the substrate bias voltage generator 1 when the substrate bias voltage Vbb is lower than the reference value.

When the substrate bias voltage Vbb becomes lower than the reference value, the potential of the node N34 becomes lower than the second power supply voltage Vss. As a result, the gate-to-source voltage of the N-transistor 34 is high, and the drain-to-source resistance of the N-transistor 34 lowers. If the substrate bias voltage Vbb further lowers, the drain-to-source resistance of the N-transistor 34 lowers by the amount of lowering of the substrate bias voltage Vbb, and the potential of the node N33 lowers to reach the second power supply voltage Vss.

The buffer circuit 37 changes the voltage level detection signal S30 from H level to L level when the potential of the node N33 lowers to the given value, and supplies it to the charge pump circuit 20. The charge pump circuit 20 stops its pumping operation upon reception of the voltage level detection signal S30 of L level. As a result, the substrate bias voltage Vbb rises.

As mentioned above, the charge pump circuit 20 repeats its pumping operation, so that the substrate bias voltage Vbb is adjusted to a given value (e.g. −1.0V).

Described hereunder is the result of simulation of operation of the substrate bias voltage generator 1 under the condition that the first power supply voltage Vcc=2.2V, and the second power supply voltage Vss=0V. Meanwhile, the reference value of the substrate bias voltage Vbb is −1.0V.

When the substrate bias voltage Vbb=−1.2V (reference value −0.2V), the potential $V_{N33}$ of the node N33 becomes 0V (=Vss).

When the substrate bias voltage Vbb=−0.87V (reference value +0.13V), the potential $V_{N33}$ of the node N33 becomes 2.2V (=Vcc).

From the result of the above simulation, it is found that the margin of fluctuation of substrate bias voltage, i.e. ΔVbb=0.33 (=−0.87−(−1.2))V is amplified as $V_{N33}$=2.2 (=2.2−0)V at the node N33. The rate of amplification is about 6.7 ($\Delta V_{N33}/\Delta Vbb$=2.2/0.33). In such a manner, according to the voltage level detection circuit 30, a slight fluctuation of the substrate bias voltage Vbb appears at the node N33 as the large fluctuation of potential. Accordingly, even if a threshold voltage (threshold voltage for deciding an input signal voltage to be H level or L level) of the buffer circuit 37 is affected by the variation or fluctuation in the manufacturing of a semiconductor device to have an error, the fluctuation of the substrate bias voltage Vbb is correctly converted into the Voltage level detection signal S30 of H level or L level which is in turn fed back to the charge pump circuit 20.

Described in the foregoing is the operation of the substrate bias voltage generator 1 in cases where the first power supply voltage Vcc is constant. The substrate bias voltage generator 1 according to the first embodiment can restrain the reference level of the substrate bias voltage Vbb from lowering extremely even if the first power supply voltage Vcc is set at high value, e.g., in connection with the product specification. This is described more in detail with reference to FIG. 3.

When the first power supply voltage Vcc is set at a reference level (e.g. 2.2V) and the second power supply voltage Vss is set at a reference level (e.g. 0V) while the substrate bias voltage Vbb keeps a reference level (e.g. −1.0V), the potential of the node N34 coincides with the second power supply voltage Vss, i.e. 0V. At this time, a current I flows equally entirely between drain-to-source of the P-transistors 31 and 32 and N-transistors 33, 34, 35 and 36. Supposing that the drain-to-source resistance of the N-transistor 36 is $R_{N36}$, the substrate bias voltage Vbb is represented by the following expression.

$$Vbb=Vss-I\times R_{N36}$$

In the substrate bias voltage generator 1, if the first power supply voltage Vcc is set at high value, the potential of the node also rises. At this time, the current which flows in each drain-to-source of the P-transistors 31 and 32 and each drain-to-source of the N-transistors 33, 34, 35 and 36 is increased by I+ΔI1. The potential $V_{N34}$ of the node N34 becomes as follows.

$$V_{N34}=Vbb+(I+\Delta I1)\times R_{N36}$$

As the potential of the node N34 rises, the potential of the node N33 also rises. The buffer circuit 37 changes the voltage level detection signal S30 from L level to H level when the potential of the node N33 rises up to a given value, and supplies it to the charge pump circuit 20. The charge pump circuit 20 starts its operation upon reception of the voltage level detection signal S30 of H level. As a result, the substrate bias voltage Vbb lowers. The charge pump circuit 20 continues its pumping operation until the potential of the node N34 coincides with the second power supply voltage Vss, namely, until the value of the substrate bias voltage Vbb establishes the following expression.

$$Vbb=Vss-(I+\Delta I1)\times R_{N36} \quad \text{(Expression 1)}$$

The voltage level detection circuit 30 is configured such that the substrate bias voltage Vbb is applied to a back gate of the N-transistor 35. When the substrate bias voltage Vbb lowers by the pumping operation of the charge pump circuit 20, the characteristics of the N-transistor 35 are changed. That is, when the substrate bias voltage Vbb lowers and the potential of the back gate of the N-transistor 35 lowers, the drain-to-source resistance of the N-transistor 35 becomes high (the drain-to-source current reduces). Hereinafter this is referred to as "substrate bias effect".

Since the first power supply voltage Vcc is set at high value as mentioned above, the drain-to-source current of the N-transistor 35 increases (I+ΔI1), however the drain-to-source current decreases (I+ΔI1−ΔI2) by the increase of the drain-to-source resistance owing to the substrate bias effect. The drain-to-source currents of the P-transistor 31 and N-transistor 33 which are respectively serially connected to the N-transistor 35 reduce by ΔI2 (I+ΔI1−ΔI2).

The P-transistor 31 and P-transistor 32 constitute the current mirror circuit. When the drain-to-source current of the P-transistor 31 reduces by ΔI2, the drain-to-source current of the P-transistor 32 also reduces by ΔI2(I+ΔI1−ΔI2). Likewise, the N-transistor 33 and N-transistor 34 constitute the current mirror circuit. When the drain-to-source current of the N-transistor 33 reduces by ΔI2, the drain-to-source current of the N-transistor 34 also reduces by ΔI2 (I+ΔI1−ΔI2). The potential $V_{N34}$ of the node N34 is established as follows.

$$V_{N34}=VSS+(I+\Delta I1-\Delta I2)\times R_{N36}$$

The charge pump circuit 20 continues its pumping operation until the potential of the node N34 coincides with the second power supply voltage Vss, namely, until the value of the substrate bias voltage Vbb establishes the following expression.

$$Vbb=Vss-(I+\Delta I1-\Delta I2)\times R_{N36} \quad \text{(Expression 2)}$$

Figure 3:
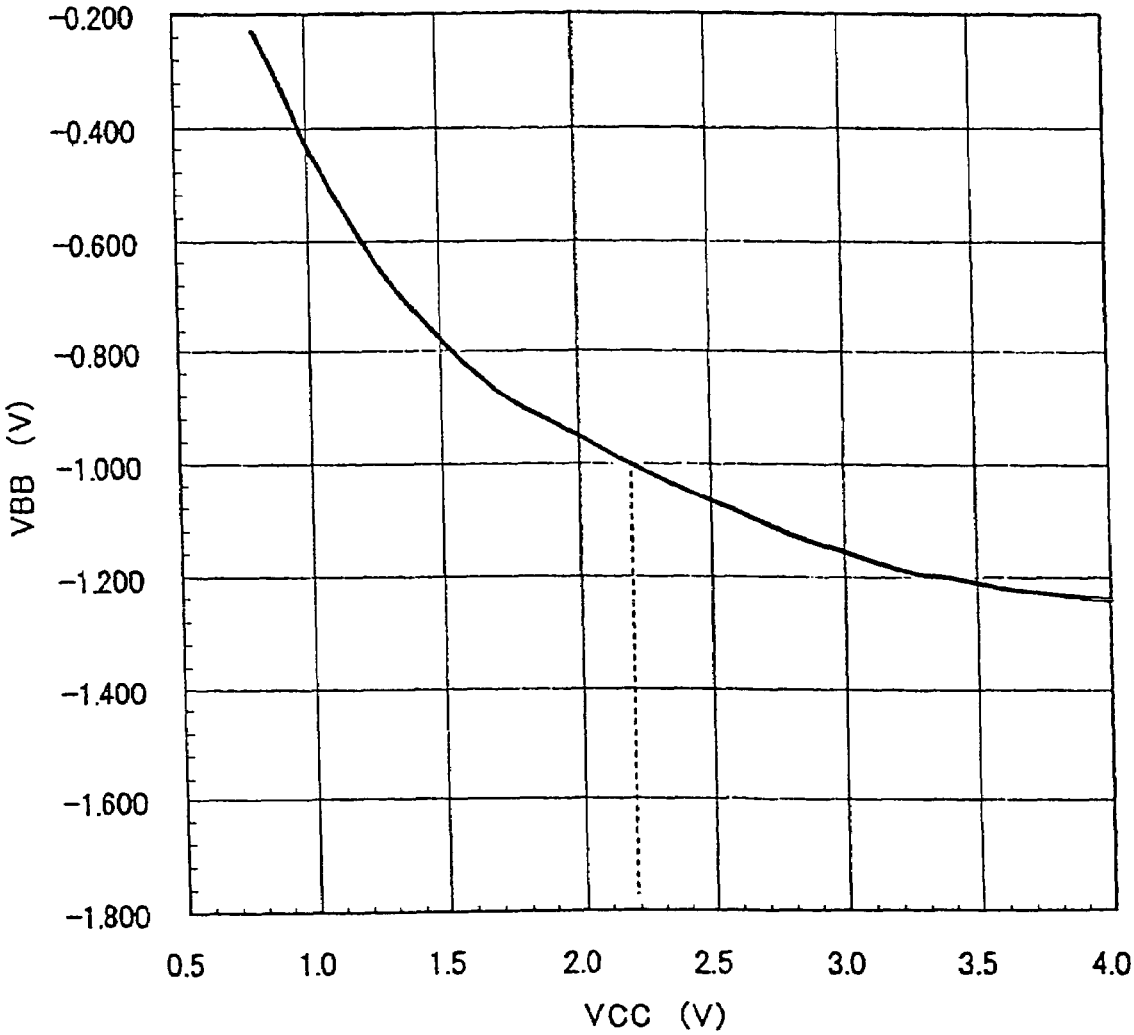
FIG. 3 is a view showing characteristic performance curve of Vcc-Vbb of the substrate bias voltage generator shown in FIG. 1.

As is evident from the comparison between Expression 1 and Expression 2, since the N-transistor 35 of the voltage level detection circuit 30 receives the substrate bias effect according to the substrate bias voltage generator 1 of the first embodiment, the reference level of the substrate bias voltage Vbb is restrained from lowering ($\Delta I2\times R_{N36}$) as the first power supply voltage Vcc rises. The substrate bias effect appears in the Vcc-Vbb characteristic of the substrate bias voltage generator 1 as shown in FIG. 3.

In the substrate bias voltage generator 1, if the first power supply voltage Vcc is set at value higher than the reference level (2.2V), the substrate bias voltage Vbb to be adjusted becomes lower than the reference level (−1.0V). However, the first power supply voltage Vcc and the substrate bias voltage Vbb have no proportionality relation (Vbb=−k×Vcc (k is constant)). That is, according to the substrate bias voltage generator 1 of the first embodiment of the invention, even if the first power supply voltage Vcc is set at high value, the reference level of the substrate bias voltage Vbb does not largely lower than the reference level of the substrate bias voltage Vbb when the first power supply voltage Vcc is in the reference level.

Figure 9:
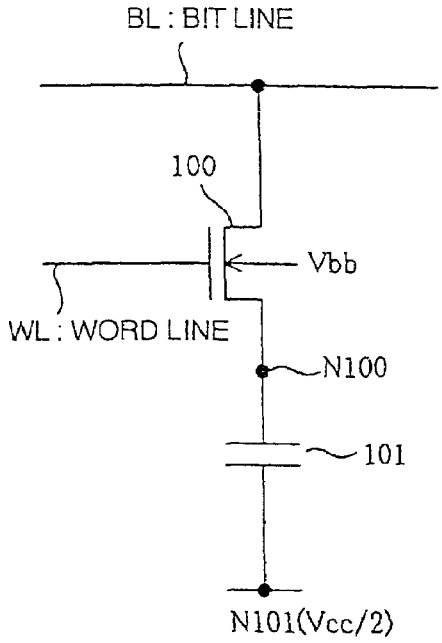
FIG. 9 (PRIOR ART)
FIG. 9 is a circuit diagram showing a configuration of a memory cell portion of a general DRAM.
Figure 10:
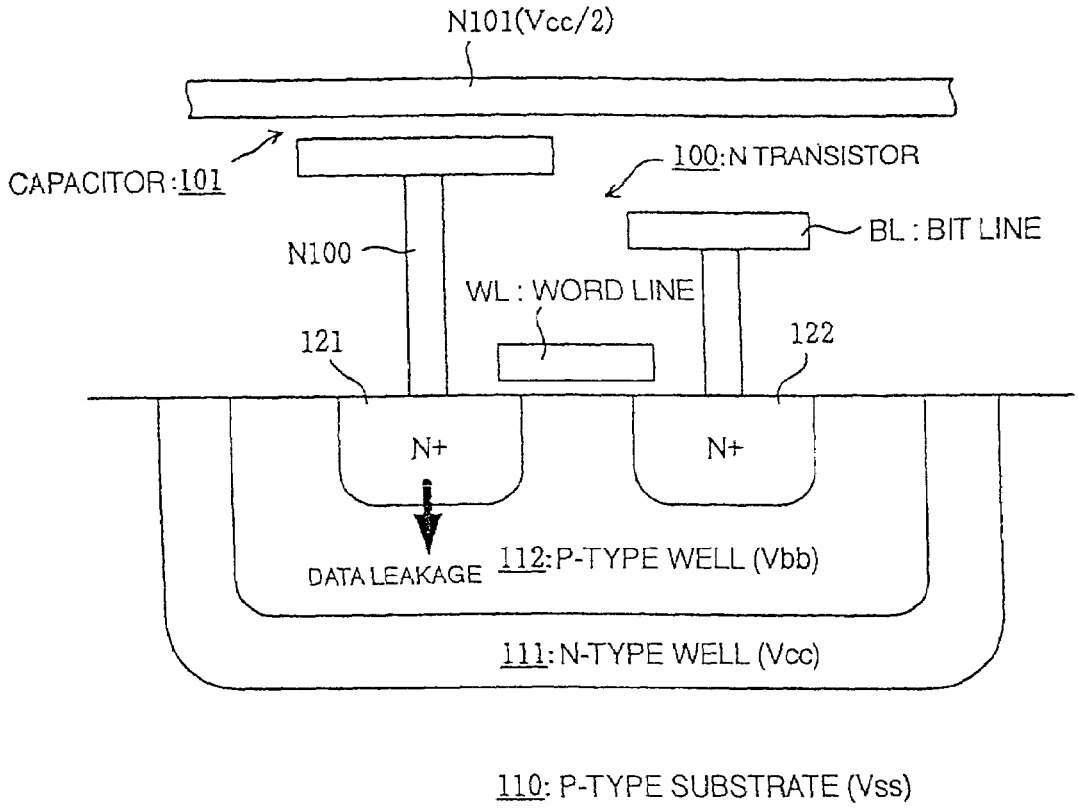
FIG. 10 (PRIOR ART)
FIG. 10 is a sectional view of the memory cell portion of a general DRAM.

Described next is a case where the substrate bias voltage generator 1 of the first embodiment is applied to the DRAM shown in FIG. 9 and FIG. 10. The DRAM is a high voltage driving type, and even if the first power supply voltage Vcc is set at high value, the reference level of the substrate bias voltage Vbb does not largely lower owing to the characteristics of the substrate bias voltage generator 1, so that the potential difference between the $N^+$ type impurity region 121 and the P-type well 112 is not extremely made large. That is, the amount of electric charge which leaks from the capacitor 101 to the P-type well 112 through the $N^+$ type impurity region 121 is significantly reduced. In such a manner, since the movement of the electric charge from the capacitor 101 is restrained, the holding time of the DRAM is kept substantially the same as a case where the DRAM is driven by the reference voltage.

Second Embodiment

Figure 4:
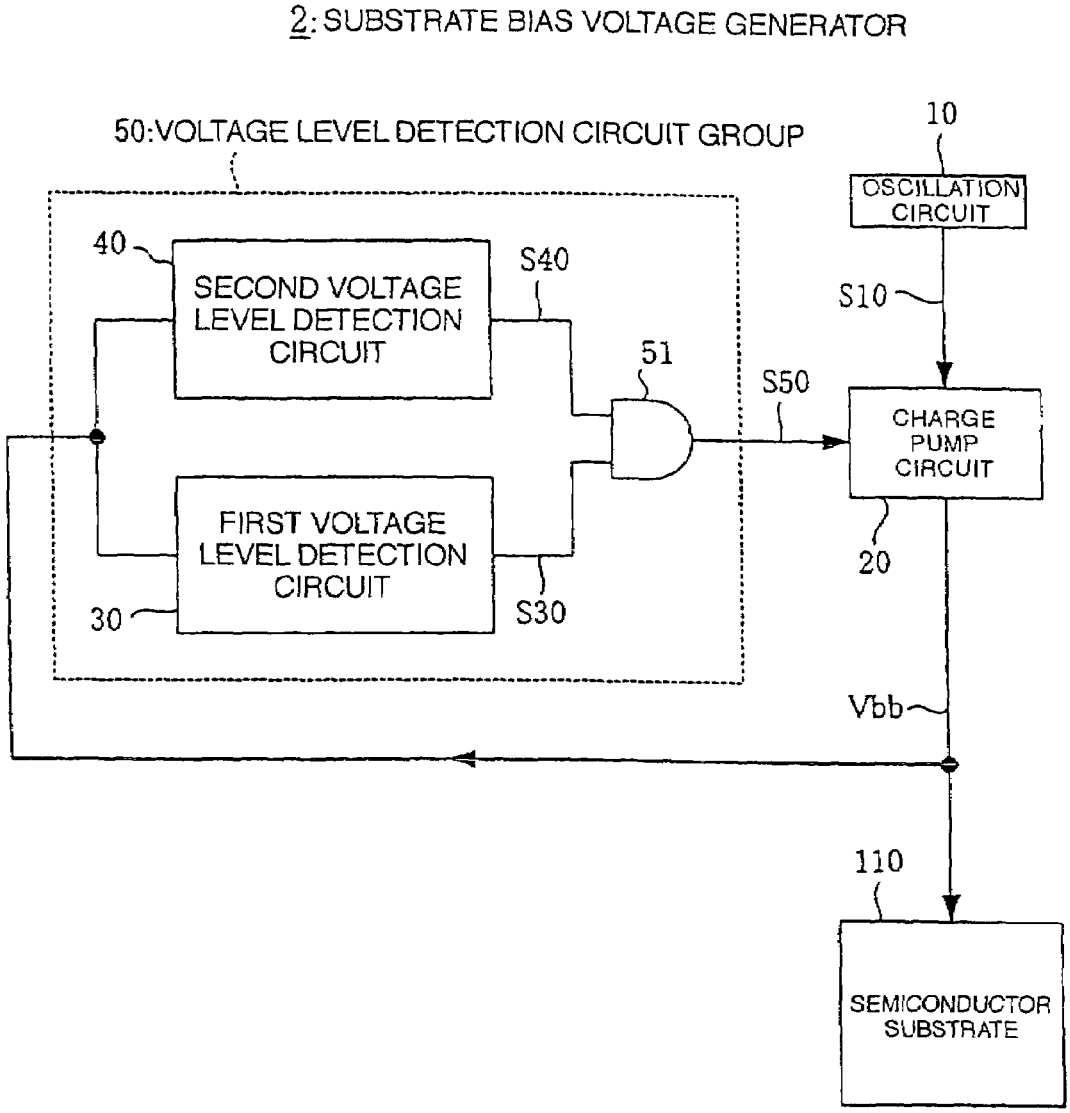
FIG. 4 is a block diagram showing a configuration of a substrate bias voltage generator according to a second embodiment of the invention.

The configuration of a substrate bias voltage generator 2 according to the second embodiment of the invention is shown in FIG. 4. Comparing the substrate bias voltage generator 2 with the substrate bias voltage generator 1 of the first embodiment of the invention, the voltage level detection circuit 30 of the first embodiment is configured to be replaced with a voltage level detection circuit group 50. That is, the substrate bias voltage generator 2 comprises an oscillation circuit 10, a charge pump circuit 20, and the voltage level detection circuit group 50 and outputs a substrate bias voltage Vbb to be applied to a semiconductor substrate 110.

The voltage level detection circuit group 50 detects a level of the substrate bias voltage Vbb and outputs a voltage level detection signal S50 of H level or L level. The voltage level detection signal S50 is inputted to the charge pump circuit 20 as a signal for controlling the pumping operation of the charge pump circuit 20.

The charge pump circuit 20 is rendered in an ON operating state when the voltage level detection signal S50 is in H level to lower the substrate bias voltage Vbb to output the lowered substrate bias voltage Vbb, and it is rendered in an OFF operating state when the voltage level detection signal S50 is in L level to raise the substrate bias voltage Vbb to output the raised substrate bias voltage Vbb.

As set forth above, the charge pump circuit 20 and voltage level detection circuit 50 form a feedback loop relative to the substrate bias voltage Vbb. The substrate bias voltage generator 2 supplies the substrate bias voltage Vbb, which is adjusted to e.g. −1.0V, to the semiconductor substrate 110.

The voltage level detection circuit group 50 comprises a first voltage level detection circuit 30, a second voltage level detection circuit 40, and a selection circuit 51 of which the first voltage level detection circuit 30 has substantially the same function and configuration as the voltage level detection circuit 30 of the substrate bias voltage generator 1 of the first embodiment of the invention.

Figure 5:
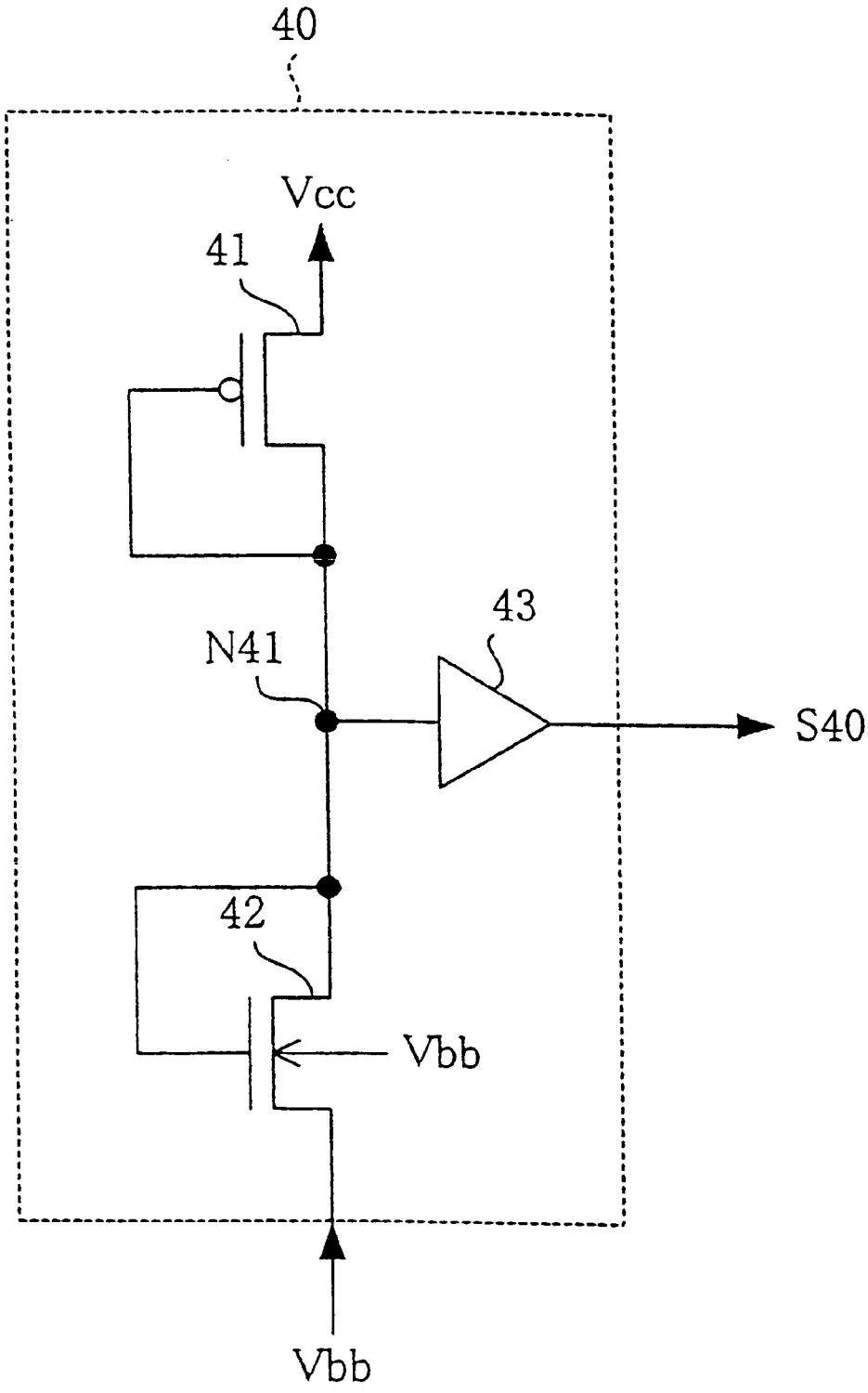
FIG. 5 is a circuit diagram showing a configuration of a second voltage level detection circuit of the substrate bias voltage generator shown in FIG. 4.

The second voltage level detection circuit 40 comprises a P-transistor 41, an N-transistor 42, and a buffer circuit 43, as shown in FIG. 5.

A first power supply voltage Vcc is applied to a source of the P-transistor 41. A gate and a drain of the P-transistor 41 are connected to a node N41.

A drain and a gate of the N-transistor 42 are connected to the node N41. The substrate bias voltage Vbb is applied to a source and a back gate of the N-transistor 42.

The buffer circuit 43 amplifies an analog voltage signal outputted to the node N41 and outputs a voltage level detection signal 540. The voltage level detection signal S40 is a logical signal having H level and L level and a voltage level of the voltage level detection signal S40 at H level is equal to the first power supply voltage Vcc while a voltage level thereof at L level is equal to the second power supply voltage Vss.

Figure 6:
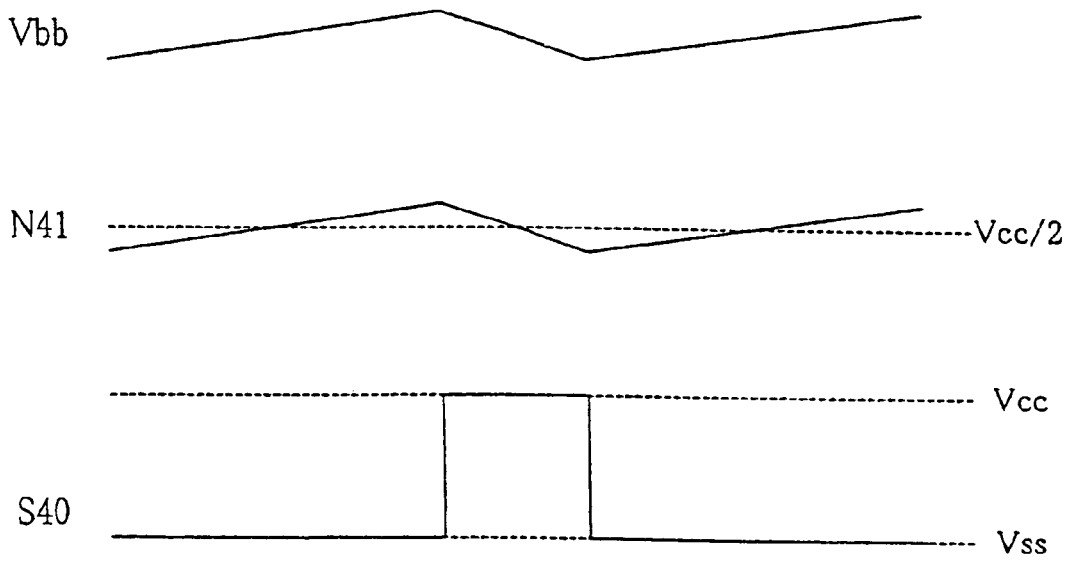
FIG. 6 is a view showing voltage waveforms representing operation of the second voltage level detection circuit of the substrate bias voltage generator shown in FIG. 4.

FIG. 6 is a view showing voltage waveforms representing operation of the voltage level detection circuit 40. If the substrate bias voltage Vbb keeps a reference value (e.g. −1.0V) in the second voltage level detection circuit 40, the potential of the node N41 keeps a given level. If the substrate bias voltage Vbb becomes higher than the reference value, the potential of the node N41 rises while on the contrary, if the substrate bias voltage Vbb becomes lower than the reference value, the potential of the node N41 lowers.

Supposing that when the first power supply voltage Vcc is 2.2V and the substrate bias voltage Vbb is kept at the reference value of −1.0V, the potential of the node N41 is half as much as the first power supply voltage Vcc, namely, kept at 1.1V. The P-transistor 41 and N-transistor 42 function as a resistor for dividing the potential difference between the first power supply voltage Vcc and substrate bias voltage Vbb to output the divided voltage to the node N41. Accordingly, when the substrate bias voltage Vbb rises up to −0.9V (+0.1V), the potential of the node N41 rises up to about 1.134V (+0.034V).

The buffer circuit 43 changes the voltage level detection signal S40 from L level to H level when the potential of the node N41 rises up to a given value, while on the contrary, it changes the voltage level detection signal S40 from H level to L level when the potential of the node N41 lowers to the given value.

As shown in FIG. 4, the selection circuit 51 is constituted by an AND gate and performs an arithmetic operation where the voltage level detection signal S30 outputted by the first voltage level detection circuit 30 and the voltage level detection signal S40 outputted by the second voltage level detection circuit 40 are ANDed, and the result of the operation is outputted as a voltage level detection signal S50.

Described next is an operation of the substrate bias voltage generator 2 of the second embodiment in cases where the first power supply voltage Vcc is set at value higher or lower than the standard level (e.g. 2.2V).

Figure 7:
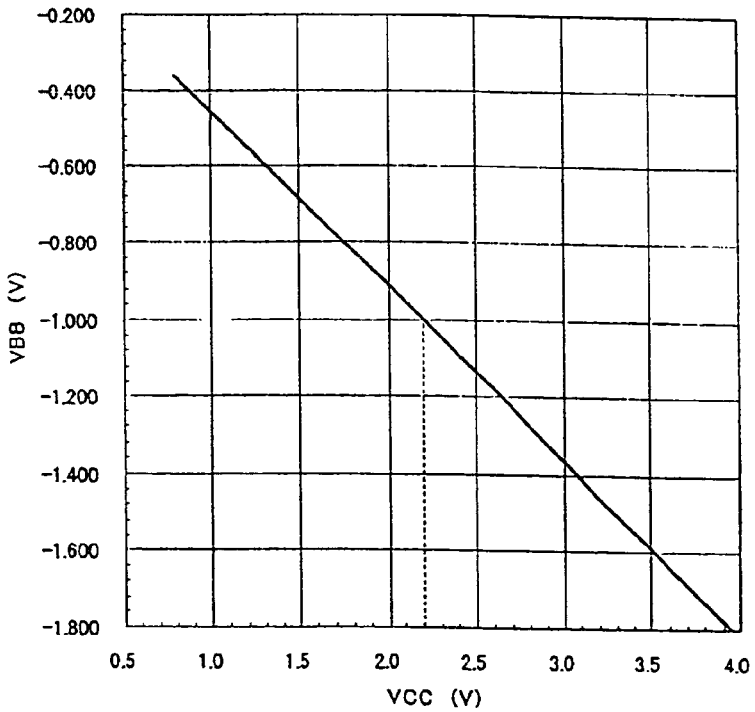
FIG. 7 is a view showing characteristic performance curve of Vcc-Vbb of the substrate bias voltage generator shown in FIG. 4 (No. 1)

First of all, the Vcc-Vbb characteristic of the substrate bias voltage generator 2 shown in FIG. 7 is a case where the selection circuit 51 selects only the voltage level detection signal S40 outputted from the second voltage level detection circuit 40 but does not select the voltage level detection signal S30 outputted from the first voltage level detection circuit 30 even if the first power supply voltage Vcc is set at any value in order to explain the function of the second voltage level detection circuit 40. The reference level of the substrate bias voltage Vbb lowers in proportion to the rising of the first power supply voltage Vcc.

The Vcc-Vbb characteristic of the substrate bias voltage generator 2 shown in FIG. 7 ignores a voltage level detection function of the first voltage level detection circuit 30 and a selection function of the voltage level detection signal of the selection circuit 51. However, the selection circuit 51 of the substrate bias voltage generator 2 practically selects either the voltage level detection signal S30 outputted from the first voltage level detection circuit 30 or the voltage level detection signal S40 outputted from the second voltage level detection circuit 40. Described hereinafter with reference to FIG. 8 is the operation and function of the substrate bias voltage generator 2 according to the second embodiment.

Figure 8:
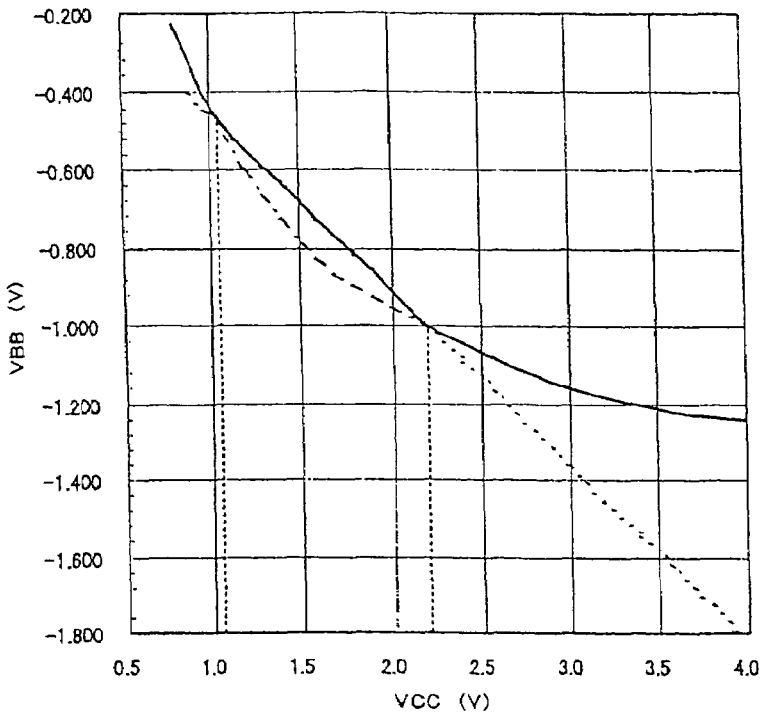
FIG. 8 is a view showing characteristic performance curve of Vcc-Vbb of the substrate bias voltage generator shown in FIG. 4 (No. 2)

FIG. 8 is a combination of FIG. 3 and FIG. 7, wherein the solid line represents the Vcc-Vbb characteristic of the substrate bias voltage generator 2 according to the second embodiment.

Described first of all is an operation of the substrate bias voltage generator 2 when the first power supply voltage Vcc is set at value hither than the standard value (2.2V), e.g. set at 3.0V.

When the substrate bias voltage Vbb rises up to −1.0V, the first voltage level detection circuit 30 outputs the voltage level detection signal S30 of H level while the second voltage level detection circuit 40 outputs the voltage level detection signal S40 of H level. Accordingly, the selection circuit 51 outputs the voltage level detection signal S50 of H level and the charge pump circuit 20 performs its pumping operation. As a result, the substrate bias voltage Vbb lowers.

When the substrate bias voltage Vbb is lower than the voltage detection level (about −1.16V) of the first voltage level detection circuit 30, the second voltage level detection circuit 40 keeps the voltage level detection signal S40 at H level but the first voltage level detection circuit 30 changes the voltage level detection signal S30 from H level to L level. Accordingly, the selection circuit 51 outputs the voltage level detection signal S50 of L level while the charge pump circuit 20 stops its pumping operation. As a result, the substrate bias voltage Vbb is adjusted to the voltage detection level (about −1.16V) of the first voltage level detection circuit 30.

When the substrate bias voltage Vbb is lower than the voltage detection level (about −1.38V) of the second voltage level detection circuit 40, the second voltage level detection circuit 40 changes the voltage level detection signal S40 from H level to L level. At this time, since the first voltage level detection circuit 30 has already outputted the voltage level detection signal S30 of L level, the selection circuit 51 outputs the voltage level detection signal S50 of L level. The charge pump circuit 20 does not perform its pumping operation.

As described above, in cases where the first power supply voltage Vcc is set at value higher than the standard level (2.2V), the substrate bias voltage generator 2 of the second embodiment adjusts the substrate bias voltage Vbb to coincide with the voltage detection level of the first voltage level detection circuit 30.

Described next is an operation of the substrate bias voltage generator 2 when the first power supply voltage Vcc is set at value lower than the standard level (2.2V) and higher than 1.05V, e.g. set at 1.5V.

When the substrate bias voltage Vbb rises up to −0.6V, the first voltage level detection circuit 30 outputs the voltage level detection signal S30 of H level while the second voltage level detection circuit 40 outputs the voltage level detection signal S40 of H level. Accordingly, the selection circuit 51 outputs the voltage level detection signal. S50 of H level while the charge pump circuit 20 performs its pumping operation. Consequently, the substrate bias voltage Vbb lowers.

When the substrate bias voltage Vbb is lower than the voltage detection level (about −0.68V) of the second voltage level detection circuit 40, the first voltage level detection circuit 30 keeps the voltage level detection signal S30 at H level while the second voltage level detection circuit 40 changes the voltage level detection signal S40 from H level to L level. Accordingly, the selection circuit 51 outputs the voltage level detection signal S50 of L level while the charge pump circuit 20 stops its pumping operation. Consequently, the substrate bias voltage Vbb is adjusted to the voltage detection level (about −0.68V) of the second voltage level detection circuit 40.

When the substrate bias voltage Vbb is lower than the voltage detection level (about −0.8V) of the first voltage level detection circuit 30, the first voltage level detection circuit 30 changes the voltage level detection signal S30 from H level to L level. At this time, since the second voltage level detection circuit 40 output the voltage level detection signal S40 of L level, the selection circuit 51 outputs the voltage level detection signal S50 of L level. The charge pump circuit 20 does not perform its pumping operation.

When the first power supply voltage Vcc is set at value lower than the standard level (2.2V) but higher than 1.05V, the substrate bias voltage generator 2 of the second embodiment adjusts the substrate bias voltage Vbb to coincide with the voltage detection level of the second voltage level detection circuit 40.

Described next is an operation of the substrate bias voltage generator 2 when the first power supply voltage Vcc is set at value lower than 1.05V, e.g. set at 0.8V.

When the substrate bias voltage Vbb rises up to −0.2V, the first voltage level detection circuit 30 outputs the voltage level detection signal S30 of H level while the second voltage level detection circuit 40 outputs the voltage level detection signal S40 of H level. Accordingly, the selection circuit 51 outputs the voltage level detection signal S50 of H level while the charge pump circuit 20 performs its pumping operation. Consequently, the substrate bias voltage Vbb lowers.

When the substrate bias voltage Vbb is lower than the voltage detection level (about −0.36V) of the first voltage level detection circuit 30, the second voltage level detection circuit 40 keeps the voltage level detection signal S40 at H level but the first voltage level detection circuit 30 changes the voltage level detection signal S30 from H level to L level. Accordingly, the selection circuit 51 outputs the voltage level detection signal S50 of L level while the charge pump circuit 20 stops its pumping operation. Consequently, the substrate bias voltage Vbb is adjusted to the voltage detection level (about −0.36V) of the first voltage level detection circuit 30.

When the substrate bias voltage Vbb is lower than the voltage detection level (about −0.4V) of the second voltage level detection circuit 40, the second voltage level detection circuit 40 changes the voltage level detection signal S40 from H level to L level. At this time, since the first voltage level detection circuit 30 has already outputted the voltage level detection signal S30 of L level, the selection circuit 51 outputs the voltage level detection signal S50 of L level. The charge pump circuit 20 does not perform its pumping operation.

As described above, in cases where the first power supply voltage Vcc is set at a level which is lower than 1.05V, the substrate bias voltage generator 2 of the second embodiment adjusts the substrate bias voltage Vbb to coincide with the voltage detection level of the first voltage level detection circuit 30.

The Vcc-Vbb characteristic of the substrate bias voltage generator 2 is summarized as follows. That is, the substrate bias voltage generator 2 adjusts the substrate bias voltage Vbb to coincide with the voltage detection level of the first voltage level detection circuit 30 in the range of $1.05V \geqq Vcc$ and $Vcc \geqq 2.2V$. The substrate bias voltage generator 2 adjusts the substrate bias voltage Vbb to coincide with the voltage detection level of the second voltage level detection circuit 40 in the range of $1.05V < Vcc < 2.2V$.

According to the substrate bias voltage generator 2 of the second embodiment, if the first power supply voltage Vcc is set at value higher than the standard level, the same effect as the substrate bias voltage generator 1 of the first embodiment can be obtained. That is, even if the first power supply voltage Vcc is set at high value, the reference level of the substrate bias voltage Vbb does not largely lower.

Further, according to the substrate bias voltage generator 2 of the second embodiment, in cases where the first power supply voltage Vcc is set at value lower than the standard level, the following effects can be obtained. This is described with reference to FIG. 4, FIG. 9 and FIG. 10.

When data "1" is written in the capacitor 101, a voltage higher than a voltage (Vcc+Vth) needs to be applied to the word line WL. Vth means a threshold voltage of the N-transistor 100.

The substrate bias voltage Vbb is applied to the back gate (P-type well 112) of the N-transistor 100 and the N-transistor 100 receives the substrate bias effect. Accordingly, the threshold voltage Vth of the N-transistor 100 rises when the substrate bias voltage Vbb lowers. That is, when the substrate bias voltage Vbb is adjusted to a low value, the threshold voltage Vth of the N-transistor 100 rises, and hence data "1" can not be written in the capacitor 101 unless a voltage of high level is applied to the word line WL.

Meanwhile the voltage to be applied to the word line WL is generated by boosting the first power supply voltage Vcc by the charge pump circuit 20. Accordingly, when the first power supply voltage Vcc is low, there is a possibility that the voltage to be applied from the charge pump circuit 20 to the word line WL lowers.

As set forth above, in cases where the first power supply voltage Vcc is set at value lower than the standard level, it is preferable that the substrate bias voltage Vbb is adjusted to be more higher Value so as to write data correctly in a memory cell. In this respect, according to the substrate bias voltage generator 2 of the second embodiment, even if the first power supply voltage Vcc is low, the substrate bias voltage Vbb is adjusted to a high value. As a result, data can be written in a memory cell Without any problem. Meanwhile, the case where the standard level of the first power supply voltage Vcc used for switching over between the first voltage level detection circuit 30 and second voltage level detection circuit 40 is 2.2V has been explained as the second embodiment. However, the standard level is not limited thereto and it is preferable that the standard level is properly determined at about intermediate value between the maximum power supply voltage and the minimum power supply voltage securing the operation of the semiconductor device including the substrate bias voltage generator.

The substrate bias voltage generator 2 of the second embodiment can automatically adjust the substrate bias voltage Vbb to an appropriate value even if the first power supply voltage Vcc is changed in level in a wider range.

Although the preferred embodiments of the invention have been described with reference to the attached drawings, the invention is not limited to such preferred embodiments. If it is evident that the person skilled in the art can conceive various changes and modification of the invention within the scope of the technical idea as set forth in claims of the invention, it is understood that such changes and modification are within the scope of the technical scope of the invention.

In the substrate bias voltage generator 2 of the second embodiment, although the voltage level detection circuit group 50 includes the first voltage level detection circuit 30 and second voltage level detection circuit 40 which have different characteristics in respect of relationship between the first power supply voltage Vcc and substrate bias voltage Vbb, it may include a plurality of circuits which have different characteristics in respect of relationship between temperature and the substrate bias voltage Vbb.

As mentioned in detail above, it is possible to obtain a voltage having excellent characteristics even if the power supply voltage and the like are changed.

What is claimed is:

1. A voltage generator comprising:

a voltage generator circuit that raises a level of an output voltage when a voltage level detection signal is a first logical level and that lowers the level of the output voltage when the voltage level detection signal is a second logical level;

a first voltage level detection circuit generating a first detection signal in accordance with a first detection level, wherein the first voltage level detection circuit includes a logical level decision circuit that provides the first detection signal responsive to a potential at a detection node, a first current mirror circuit connected to a first potential source, the detection node and the voltage generator circuit, wherein the first current mirror circuit includes a first transistor having a first terminal connected to the first potential source, a second terminal, and a control terminal, and a second transistor having a first terminal connected to the detection node, a second terminal connected to a predetermined level that is changed according to the level of the output voltage, and a control terminal connected to the control terminal of the first transistor, and a second current mirror circuit connected to a second potential source, the detection node and the first current mirror circuit;

a second voltage level detection circuit generating a second detection signal in accordance with a second detection level that is lower than the first detection level; and a selection circuit connected to the first and second voltage level detection circuits, wherein the selection circuit outputs a signal equivalent to the first detection signal as the voltage level detection signal when a power supply voltage level is equal to or higher than a first voltage level or when the power supply voltage level is equal to or lower than a second voltage level that is lower than the first voltage level, and wherein the selection circuit outputs a signal equivalent to the second detection signal as the voltage level detection signal when the power supply voltage level is lower than the first voltage level and higher than the second voltage level.

2. A voltage generator according to claim 1, wherein the second current mirror circuit includes, a third transistor having a first terminal connected to the second potential source, a second terminal connected to the detection node, and a control terminal, and a fourth transistor having a first terminal connected to the second potential source, a second terminal, and a control terminal connected to the second terminal of the fourth transistor and the control terminal of the third transistor.

3. A voltage generator according to claim 1, wherein the voltage generator circuit raises the level of the output voltage when in an Off operating state, and lowers the level of the output voltage when in an ON operating state.

4. A voltage generator according to claim 1, wherein the first current mirror circuit further includes a resistor element having one end connected to the output voltage of the voltage generator circuit, and having a second end connected to the second terminal of the second transistor.

5. A voltage generator according to claim 1, wherein the first voltage level detection circuit further comprises a resistor element connected between the first and second current mirror circuits, that adjusts a current flowing between the first and second current mirror circuits, wherein the resistor element is a third transistor having a back gate connected to the output voltage of the voltage generator circuit.

6. A voltage generator according to claim 1, wherein the second voltage level detection circuit includes, a second logical level decision circuit that provides the second detection signal in response to a potential at a second detection node, a third transistor having a first terminal connected to the second potential source, a second terminal connected to the second detection node and a control terminal connected to the second detection node, and a fourth transistor having a first terminal, a second terminal connected to the second detection node, and a control terminal connected to the second detection node.

7. A voltage generator according to claim 1, further comprising an oscillation circuit connected to the voltage generator circuit, the oscillation circuit outputting a pulse signal to the voltage generator circuit.

8. A voltage generator according to claim 1, wherein the voltage generator circuit is a charge pump circuit.

9. A voltage generator comprising:

a semiconductor substrate;

a voltage generator circuit connected to the semiconductor substrate, the voltage generator supplying a predetermined voltage to the semiconductor substrate in response to a control signal;

a first voltage level detection circuit connected to the semiconductor substrate, the first voltage level detection circuit generating a first detection signal when a voltage level of the semiconductor substrate is lower than a first voltage level, wherein the first voltage level detection circuit includes a buffer circuit connected to the voltage generator circuit, the buffer circuit generating the first detection signal, a first current mirror circuit connected to the buffer circuit, the semiconductor substrate and a first potential source, the first current mirror circuit including a first NMOS transistor having a source connected to the semiconductor substrate, a drain connected to the buffer circuit, and a gate, and a second NMOS transistor having a source connected to the first potential source, a drain and a gate connected to the gate of the first NMOS transistor, and a second current mirror circuit connected to the buffer circuit, a second potential source and the drain of the second NMOS transistor;

a second voltage level detection circuit connected to the semiconductor substrate, the second voltage level detection circuit generating a second detection signal when the voltage level of the semiconductor substrate is lower than a second voltage level that is lower than the first voltage level; and a selection circuit connected to the first and second voltage level detection circuits, wherein the selection circuit outputs a signal equivalent to the first detection signal as the control signal when a power supply voltage level is equal to or higher than the first voltage level, or when the power supply voltage level is equal to or lower than the second voltage level, and wherein the selection circuit outputs a signal equivalent to the second detection signal as the control signal when the power supply voltage level is lower than the first voltage level and higher than the second voltage level.

10. A voltage generator according to claim 9, wherein the first current mirror circuit is connected to the semiconductor substrate through a resistor element.

11. A voltage generator according to claim 9, wherein the first current mirror circuit is connected to the second current mirror circuit through a resistor element.

12. A voltage generator according to claim 9, wherein the second current mirror circuit includes, a first PMOS transistor having a source connected to the second potential source, a drain connected to the buffer circuit, and a gate, and a second PMOS transistor having a source connected to the second potential source, a drain connected to the first current mirror circuit and a gate connected to the gate of the first PMOS transistor and the drain of the second PMOS transistor.

13. A voltage generator according to claim 9, further comprising an oscillation circuit connected to the voltage generator circuit, the oscillation circuit outputting a pulse signal to the voltage generator circuit.

14. A voltage generator according to claim 9, wherein the voltage generator circuit is a charge pump circuit.

15. A voltage generator according to claim 9, wherein the second voltage level detection circuit includes, a second buffer circuit connected to the voltage generator circuit, the second buffer circuit generating the second detection signal, a first PMOS transistor having a source connected to the second potential source, a drain connected to the second buffer circuit and a gate connected to the second buffer circuit, and a third NMOS transistor having a source connected to the semiconductor substrate, a drain connected to the second buffer circuit and a gate connected to the second buffer circuit.

16. A voltage generator comprising:

a voltage generator circuit that raises a level of an output voltage when a voltage level detection signal is a first logical level and that lowers the level of the output voltage when the voltage level detection signal is a second logical level;

a first voltage level detection circuit generating a first detection signal in accordance with a first detection level;

a second voltage level detection circuit generating a second detection signal in accordance with a second detection level that is lower than the first detection level, wherein the second voltage level detection circuit includes a logical level decision circuit that provides the second detection signal in response to a potential at a detection node, a first transistor having a first terminal connected to a first potential source, a second terminal connected to the detection node and a control terminal connected to the detection node, and a second transistor having a first terminal, a second terminal connected to the detection node, and a control terminal connected to the detection node; and a selection circuit connected to the first and second voltage level detection circuits, wherein the selection circuit outputs a signal equivalent to the first detection signal as the voltage level detection signal when a power supply voltage level is equal to or higher than a first voltage level or when the power supply voltage level is equal to or lower than a second voltage level that is lower than the first voltage level, and wherein the selection circuit outputs a signal equivalent to the second detection signal as the voltage level detection signal when the power supply voltage level is lower than the first voltage level and higher than the second voltage level.

17. A voltage generator according to claim 16, wherein the first voltage level detection circuit includes, a second logical level decision circuit that provides the first detection signal in response to a potential at a second detection node, a first current mirror circuit connected to a second potential source, the second detection node and the voltage generator circuit, and a second current mirror circuit connected to the first potential source, the second detection node and the first current mirror circuit.

18. A voltage generator according to claim 17, wherein the first current mirror circuit includes a third transistor having a first terminal connected to the second potential source, a second terminal and a control terminal, and a fourth transistor having a first terminal connected to the second detection node, a second terminal connected to a predetermined level that is changed according to the level of the output voltage, and a control terminal connected to the control terminal of the third transistor.

19. A voltage generator according to claim 17, wherein the second current mirror circuit includes, a third transistor having a first terminal connected to the first potential source, a second terminal connected to the second detection node, and a control terminal, and a fourth transistor having a first terminal connected to the first potential source, a second terminal, and a control terminal connected to the second terminal of the fourth transistor and the control terminal of the third transistor.

20. A voltage generator according to claim 17, wherein the voltage generator circuit raises the level of the output voltage when in an Off operating state, and lowers the level of the output voltage when in an ON operating state.

21. A voltage generator according to claim 18, wherein the first current mirror circuit further includes a resistor element having one end connected to the output voltage of the voltage generator circuit, and having a second end connected to the second terminal of the fourth transistor.

22. A voltage generator according to claim 17, wherein the first voltage level detection circuit further comprises a resistor element connected between the first and second current mirror circuits, that adjusts a current flowing between the first and second current mirror circuits, wherein the resistor element is a third transistor having a back gate connected to the output voltage of the voltage generator circuit.

23. A voltage generator according to claim 16, further comprising an oscillation circuit connected to the voltage generator circuit, the oscillation circuit outputting a pulse signal to the voltage generator circuit.

24. A voltage generator according to claim 16, wherein the voltage generator circuit is a charge pump circuit.

* * * * *